US006671891B2

(12) United States Patent
Qi et al.

(10) Patent No.: US 6,671,891 B2
(45) Date of Patent: Jan. 6, 2004

(54) COMMODE-URINAL

(76) Inventors: Xiaoming Qi, 1118, No.19 Building, Block12 Heping Street, Chaoyang District 100013 Beijing (CN); Ru Qi, 1118, No.19 Building,Block12 Heping Street, Chaoyang District 100013 Beijing (CN)

( * ) Notice: Subject to any disclaimer, the term of this patent is extended or adjusted under 35 U.S.C. 154(b) by 358 days.

(21) Appl. No.: 09/799,888

(22) Filed: Mar. 7, 2001

(65) Prior Publication Data

US 2001/0009041 A1 Jul. 26, 2001

Related U.S. Application Data

(63) Continuation-in-part of application No. PCT/CN00/00064, filed on Mar. 27, 2000.

(30) Foreign Application Priority Data

Jul. 1, 1999 (CN) ..... 99214737 U

(51) Int. Cl.[7] ..... E03D 1/22
(52) U.S. Cl. ..... 4/340; 4/341; 4/342
(58) Field of Search ..... 4/340, 341, 342, 4/420.3, 420.4, 443, 444, 445, 446, 447, 485, 486, 639, 902

(56) References Cited

U.S. PATENT DOCUMENTS

| | | | | | |
|---|---|---|---|---|---|
| 303,027 | A | * | 8/1884 | McComb | 4/420 |
| 1,612,665 | A | * | 12/1926 | Tivoli | 4/420.3 |
| 2,070,622 | A | * | 2/1937 | Salvoni | 4/445 |
| 2,104,210 | A | * | 1/1938 | Salvoni | 4/420.3 |
| 3,044,076 | A | * | 7/1962 | Martini | 4/420.4 |
| 3,134,985 | A | | 6/1964 | Pasquale | 4/7 |
| 3,577,567 | A | * | 5/1971 | Wintercorn | 4/445 |
| 3,735,428 | A | * | 5/1973 | Olivero | 4/341 |
| 3,987,502 | A | | 10/1976 | Hartmann | 4/75 |
| 4,045,827 | A | | 9/1977 | Morris et al. | 4/3 |
| 4,069,521 | A | | 1/1978 | Aleman | 4/300 |
| 4,089,073 | A | | 5/1978 | Campbell | 4/3 |
| 4,137,579 | A | * | 2/1979 | Soler | 4/311 |
| 4,145,767 | A | * | 3/1979 | Ibel | 4/420.3 |
| 4,207,628 | A | * | 6/1980 | Ibel | 4/445 |
| 4,868,936 | A | * | 9/1989 | Crocoli | 4/663 |
| 5,050,248 | A | * | 9/1991 | Olivero | 4/341 |
| 5,345,619 | A | * | 9/1994 | Harrington | 4/341 |
| 5,734,997 | A | * | 4/1998 | Raff | 4/420.2 |

FOREIGN PATENT DOCUMENTS

| | | | | |
|---|---|---|---|---|
| DE | 196 25 658 A1 | | 1/1998 | E03D/13/00 |
| GB | 2280913 A | * | 2/1995 | |

* cited by examiner

*Primary Examiner*—Gregory Huson
*Assistant Examiner*—Khoa D. Huynh
(74) *Attorney, Agent, or Firm*—Yi Li

(57) ABSTRACT

A commode-urinal is provided with a cleaning-water path connected with water-supplying facilities; the commode-urinal is provided with a draining-off path connected with a sewer-path. The commode-urinal is used together with commode-excrement container as a set thereby the commode can process urine and excrement by different methods. When it is used to process urine, it can effectively solve the existing problems of using water unreasonably and wasting water due to unscientifical processing methods.

17 Claims, 10 Drawing Sheets

COMMODE-URINAL

This is a continuation-in-part of International Application PCT/CN00/00064, with a filing date of Mar. 27, 2000.

FIELD OF THE INVENTION

The present invention relates to a sanitary ware, specifically to a commode-urinal.

BACKGROUND OF THE INVENTION

During using, the processing method of urine of the commode of known art, whatever it is flushing type or rinsing type, is the same as the processing method being used for excrement. And the commode of known art whatever it is flushing type or rinsing type, its technical feature shows that it is designed for processing excrement. Therefore, when it is used to process urine the commode of known art, whatever it is flushing type or rinsing type, has the problems of using water unreasonably and wasting water due to unscientifically processing method.

At the present, the design related to water saving of commode is developed mainly about two-steps or multi-steps method of controlling and draining off water of water tank of commode. However, the minimum amount of draining off water of each step of water tank could not be less than the lowest amount of flushing water that is required by the technical feature of commode itself. At the present, therefore, even it is the most advanced water saving commode, its water amount used could not be less than 3 (three) liters. Therefore, the above-mentioned problem could not be solved thoroughly by modifying the method of draining off water of the water tank of a commode.

At the present, there is a urinal used independently, but it is upright and it is suitable only for male, and female could not use it at all. Therefore, this kind of urinal is not suitable for using in the bathroom of a family.

The object of the invention is to provide a commode-urinal, its method of processing urine is different from the method of processing excrement. It can solve the problems efficiently of using water unreasonably and wasting water caused by unscientific processing method, when the commode of known art is used to process urine.

DISCLOSURE OF THE INVENTION

The technical scheme of the invention is: a commode-urinal, the commode-urinal is provided with a special cleaning water path which is connected to a water supplying facility; the commode-urinal is provided with a special draining off path which is connected to a sewer path, the draining off path of the commode-urinal is provided with a water-containing elbow for water-sealing; the commode-urinal is provided with a pivotal means and connected to the upper part of the commode-excrement container through the pivotal means. The sewer path connected to the draining off path of the commode-urinal is drainage or draining-part of sewer path of the commode-excrement container or draining-part of a bath tub. The water supplying facility connected to cleaning-water path of commode-urinal is a water-supplying tank of the commode-excrement container or a tap water pipe. The cleaning-water path of the commode-urinal is provided with a controlling-switch. The controlling-switch could be a manual control valve or an infrared control valve, and also could be a spring valve. The bottom of the inner chamber of the commode-urinal is of inclined form. The outlets of cleaning-water path of the commode-urinal could be set on one side or perimeter edge of the bottom of the inner chamber of commode-urinal. The outlets of cleaning-water path of the commode-urinal could be set on one side or perimeter edge of upper part of the inner chamber of the commode-urinal. The commode-urinal could be made of metal and could be also made of plastic, ceramics material and non-metal material and so on. The commode-urinal is adapted on the commode-excrement container and it is used with the commode-excrement container as a set. The commode-excrement container is provided with a bowl. The bowl is connected through cleaning-water path of the commode-excrement container with water-tank system assembly consisted of water tank body and controlling mechanism of supplying-draining off water. The lower part of the bowl is provided with a draining-off path connected with sewerage. On the basis of the present commode, a commode-urinal is provided additionally. The commode-urinal is installed above the commode-excrement container and is connected through the pivotal means to the main body of the commode.

In the technical scheme of the invention, the urinal is located above the seating-pad of the commode-excrement container and is connected to the the pivotal means which is firmly connected by bolts to the main body of the commode, thus the urinal can be either set horizontally or be set upright. When the urinal is set horizontally, the commode is in urinating condition; When the urinal is set upright, the commode is in defecating condition.

In the technical scheme of the invention, the outlet of the draining-off path of the urinal is connected with sewerage or sewer-part of the draining-off path of the commode-excrement container, or sewerage of a bath tub directly. When the urinal is set horizontally, the inner chamber bottom of the urinal is of inclined-state toward its draining-off direction, so as causing the liquid in the urinal drains off automatically. The outlet of the urinal is higher than the inlet of draining-off path of it. The inlet of the draining-off path of the urinal is the highest end of the path. Therefore, when the urinal is used to process urine, it can drain off automatically and less amount of water is required for cleaning the inner surface of the urinal. In the meantime, since the sectional area of the draining-off path of the urinal is much smaller than the sectional area of the draining-off path of the commode excrement container, and its water-containing elbow for water-sealing is also much smaller than the water-containing elbow of commode-excrement container, the water used for water-sealing is reduced substantially. Due to the structural combination of the urinal, it is insured that the invention can save water significantly during urine processing.

Because the present invention utilizes the urinal in conjunction with the commode, it enables processing of urine scientifically, therefore, saving water significantly during urine processing. Hence, using less than 0.5 (half) liter of water each time is enough. In the meantime, since the urinal is connected through the pivotal means to the main body of the commode so that the operation of changing the state from urinating to defecating or vice versa is quite simple.

THE PREFERRED EMBODIMENTS

Embodiment 1

Figure 10:
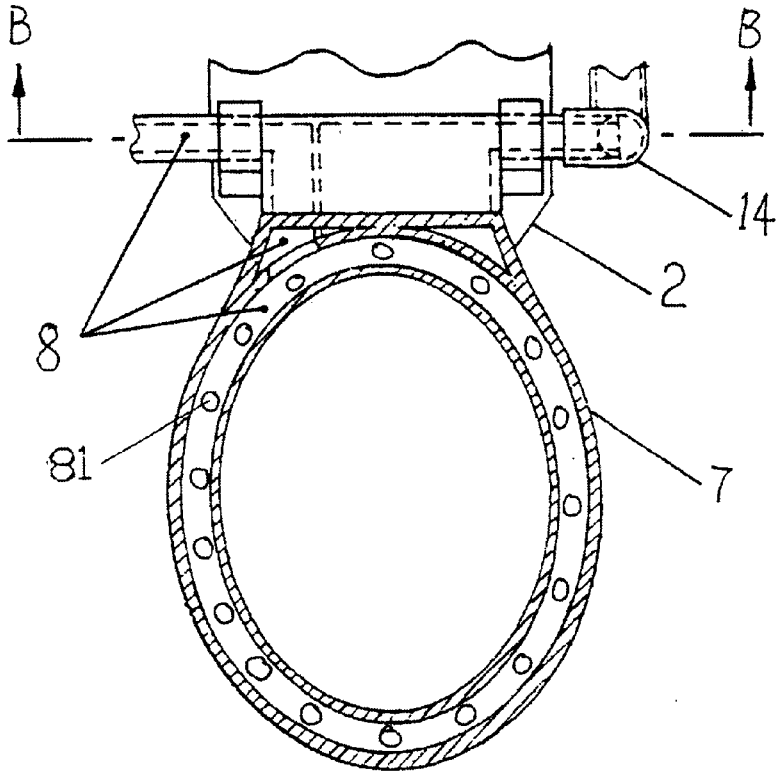
FIG. 10 is the A—A sectional view of FIG. 9.
Figure 11:
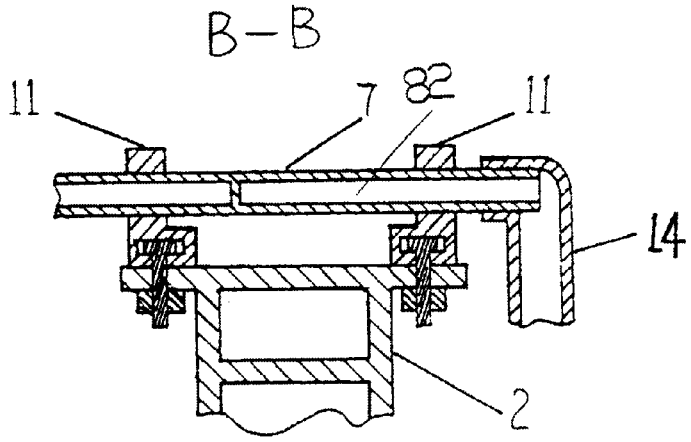
FIG. 11 is the B—B sectional view of FIG. 10, which shows that the outlet of the commode-urinal is provided on one side of an inner chamber bottom of the commode-urinal.

As shown in FIGS.1, 2, 3 and 4, the commode-urinal and the commode-excrement container are provided as a set. The commode-excrement container is provided with a bowl 4, the bowl 4 of commode-excrement container is connected with water-tank system assembly I consisted of water-tank body and controlling-mechanism of supplying and draining-off water through cleaning-water path 5 of commode-excrement container, the lower part of bowl 4 of the commode-excrement container is provided with draining-off path 3 of the commode-excrement container, and the path 3 is connected with sewerage. During production of commode-excrement container, there is a location for adapting the commode-urinal for use as a set so that the commode-urinal of the invention can be added. The commode-urinal is located above the commode-excrement container and connected through the pivotal means to the main body 2 of the commode-excrement container. The commode-urinal 7 is provided with cleaning-water path 8 connected with water-tank system assembly 1; the cleaning-water path 8 is provided with a controlling-switch 18, the controlling switch 18 can be a manual control valve and can also be an infrared control valve or a spring valve. Switching on the controlling switch 18, water can be flushed with an amount controlled by an user or at a constant amount. The commode-urinal 7 is provided with draining-off path 14 of the commode-urinal, and the path 14 is connected with sewer part of draining-off path 3 of the commode-excrement container through outlet 13 of the draining-off path. The bottom 12 of inner chamber of the commode-urinal is of inclined form, upper part in the commode-urinal 7 is provided with one end of cleaning-water path 8 of the commode-urinal, on one side of the bottom in the commode-urinal 7 is provided with one end of draining-off path 14 of commode-urinal, as shown in FIGS. 10 and 11. Both commode-urinal and commode-excrement container are provided with seating-pads 6 and 9, respectively.

Figure 1:
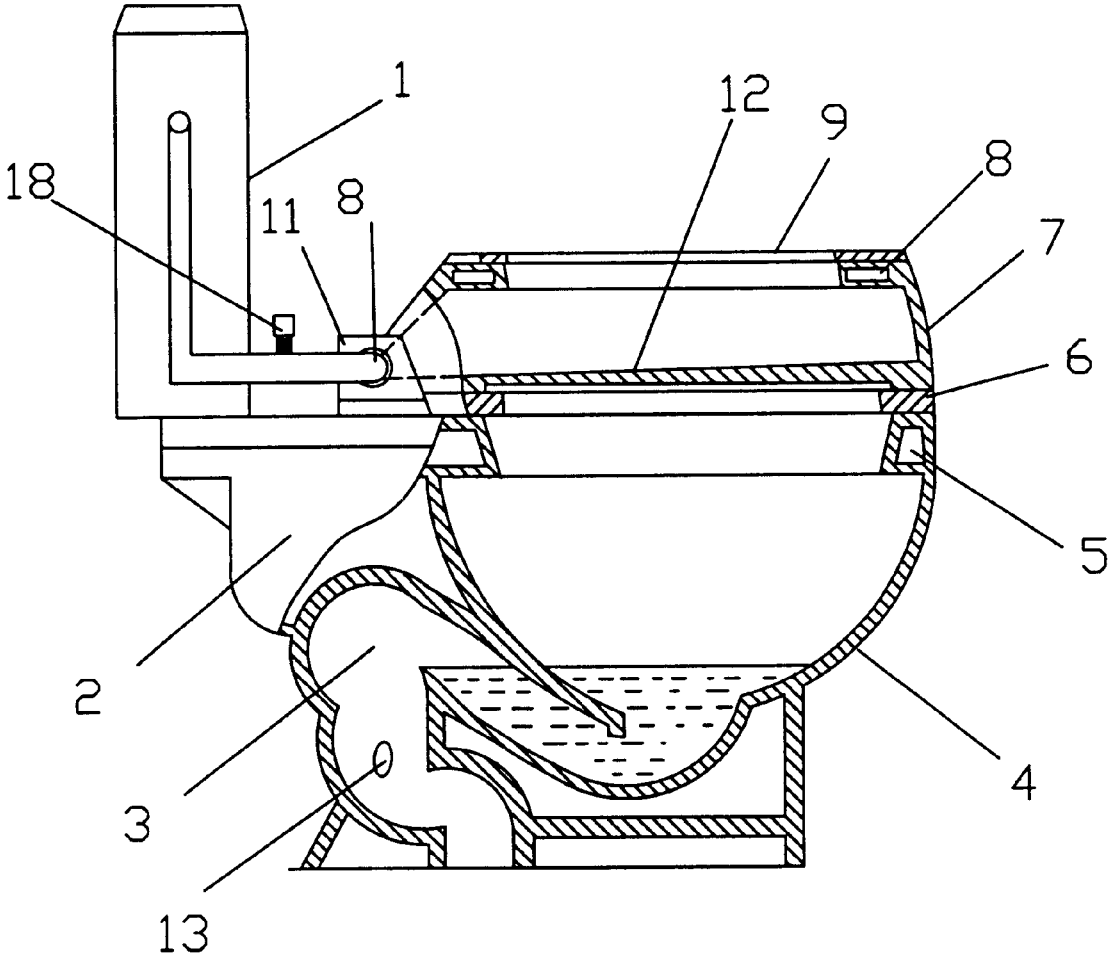
FIG. 1 is a structural sketch of the commode proposed according to the invention.
Figure 2:
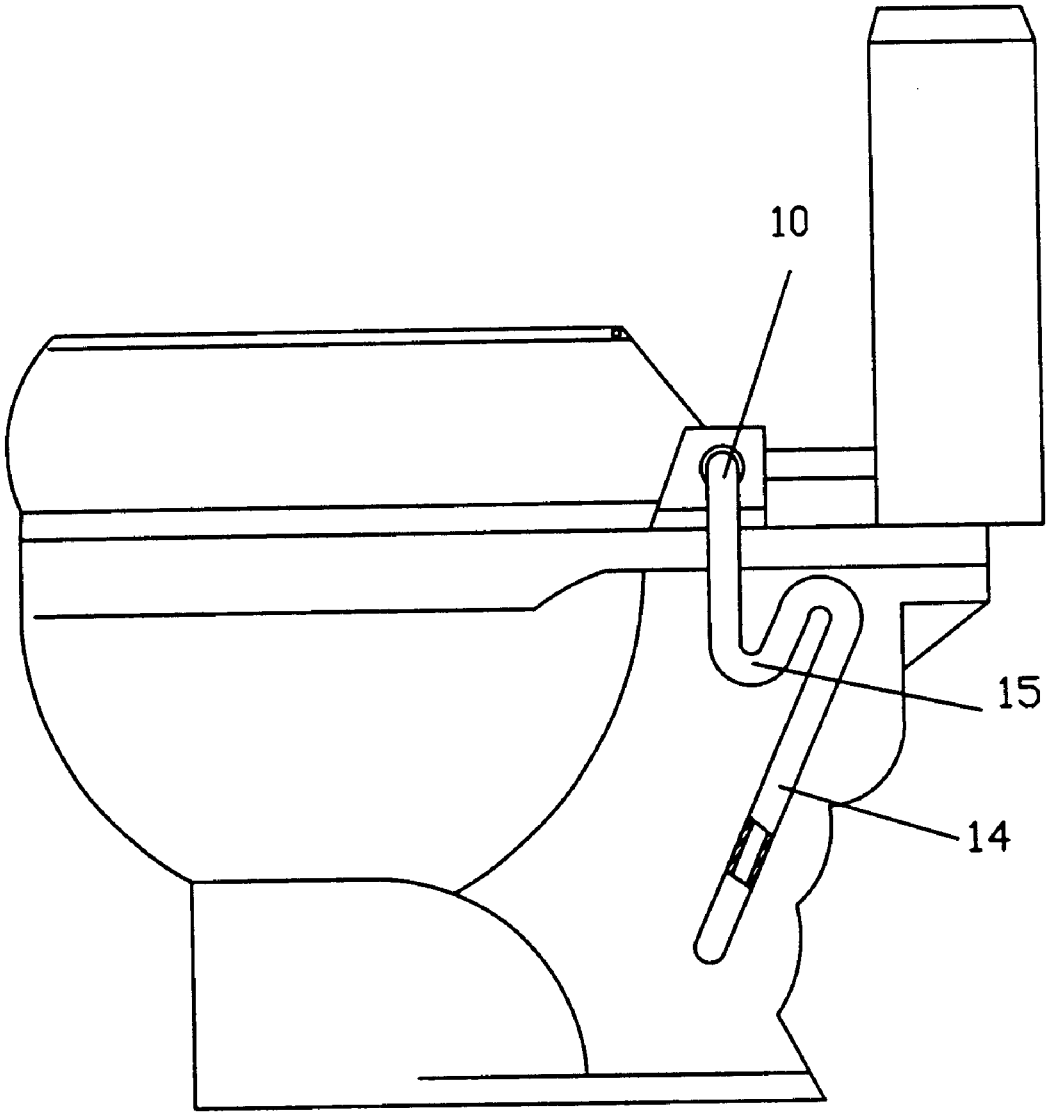
FIG. 2 is a side sketch of the commode proposed according to the invention.
Figure 3:
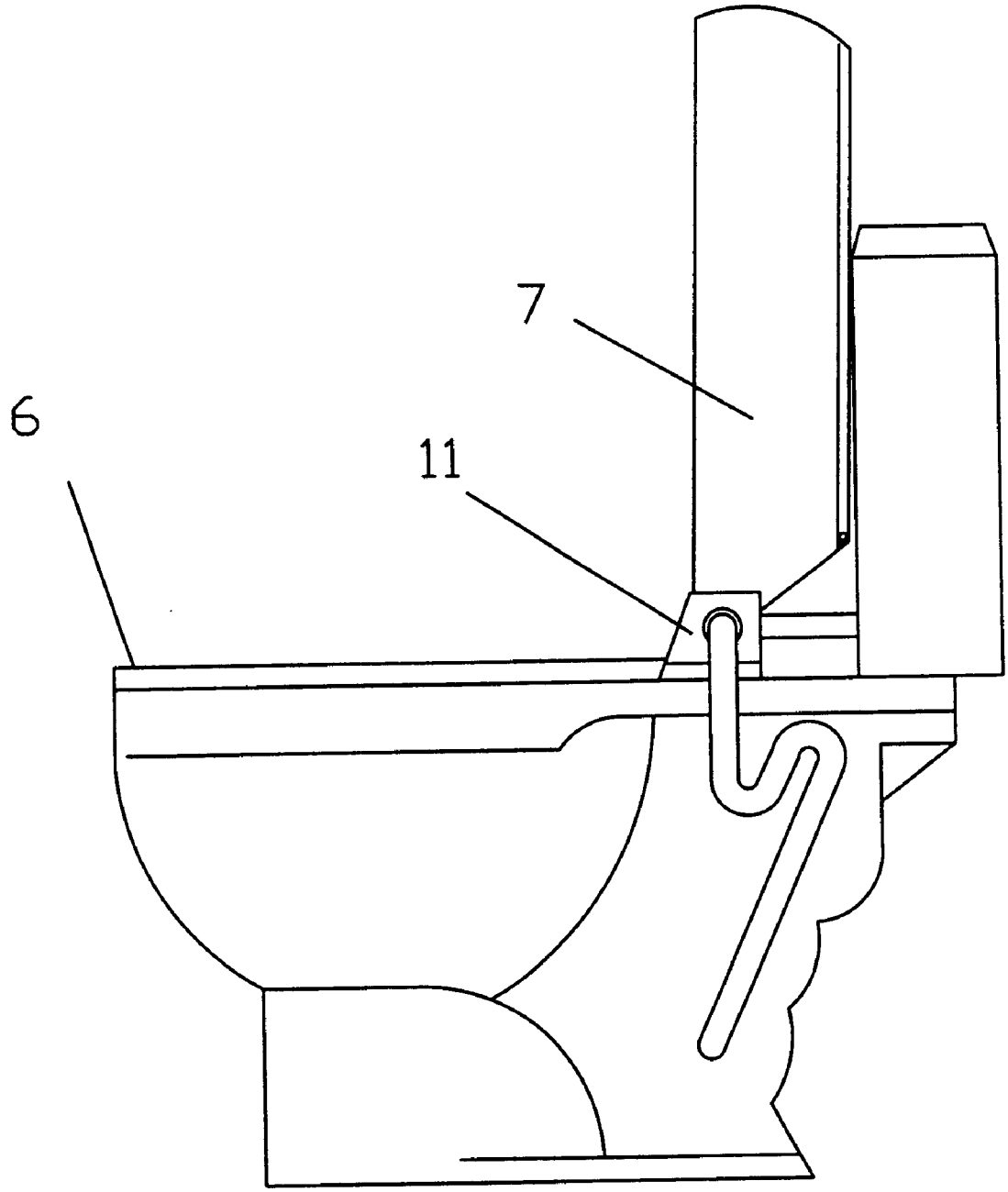
FIG. 3 is a structural sketch of the commode proposed according to the invention in the state used for defecating.
Figure 4:
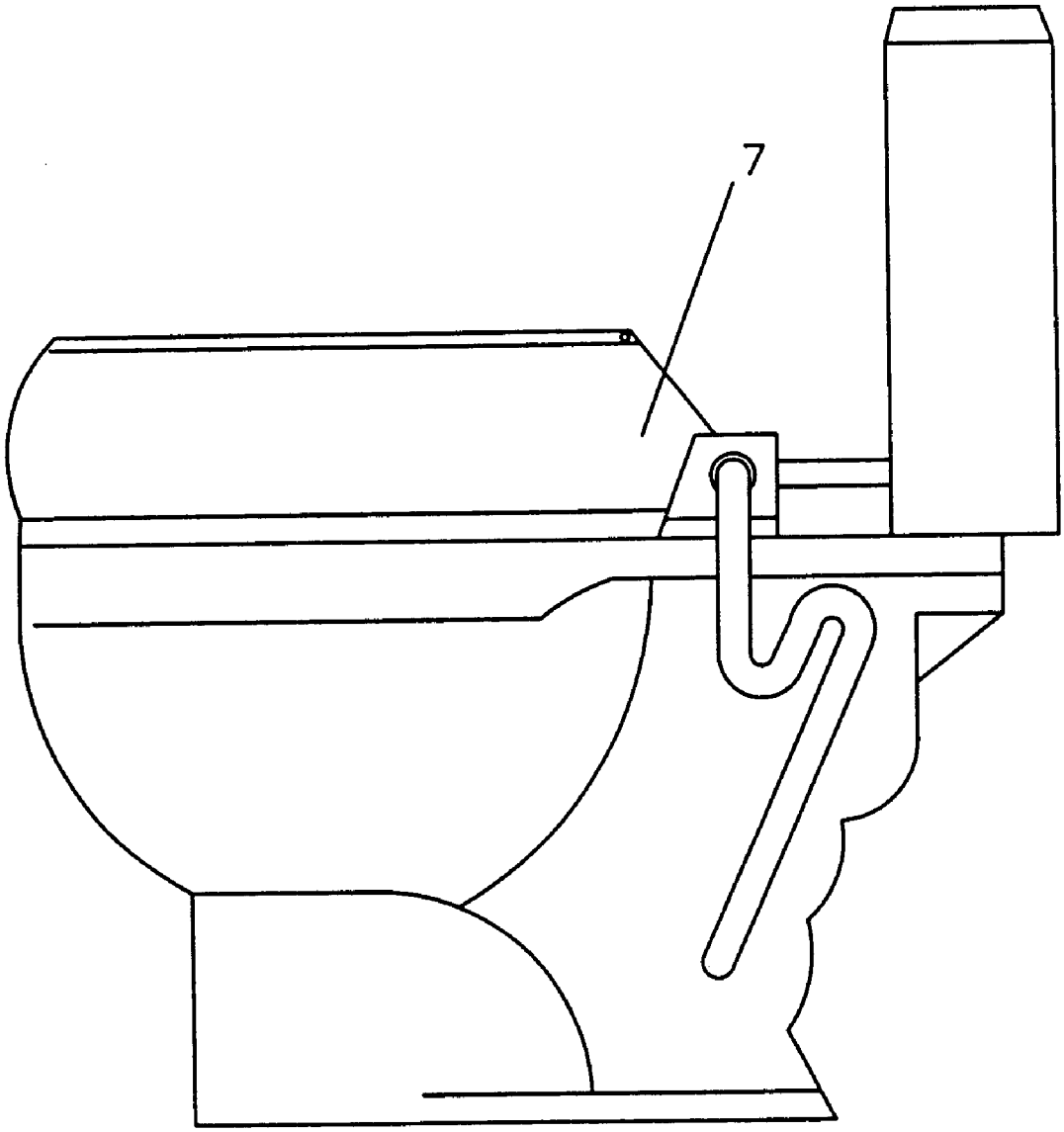
FIG. 4 is a structural sketch of the commode proposed according to the invention in the state used for urinating.

In the embodiment, as shown in FIG. 3, commode-urinal 7 is located above seating-pad 6 of the commode-excrement container and is connected to pivotal means 11 of the urinal, wherein the pivotal means 11 is firmly connected to the main body of the commode by bolts, thereby urinal could be set horizontally, and can be turned upright. When the urinal is set horizontally, the commode is of the state used for urinating; when the urinal is set upright, the commode is of the state used for defecating.

The outlet 13 of the draining-off path 14 of the urinal is connected directly with sewerage or sewer part of the draining-off path of the commode excrement container. When the urinal is set horizontally, the bottom of inner chamber of the urinal is of inclined state toward its outlet of draining-off, thereby the liquid in the urinal can drain off automatically. Moreover, draining-off outlet 82 of the urinal is higher than the inlet 10 of the draining-off path 14 of the urinal and the inlet 10 of the draining-off path of the urinal is the highest end of the path 14 so that when the urinal is used for processing urine, it can drain off automatically, therefore only small amount of water is required for cleaning inner surface of the urinal. In the meantime, because the sectional area of the draining-off path of the urinal is much smaller than the sectional area of the draining-off path of the commode-excrement container, and its water-containing elbow 15 for water-sealing is also much smaller, the amount of water used for water-sealing is reduced substantially; Thereby the structural combination of urinal insures a significant water-saving during urine-processing.

The commode-urinal could be made of metal material such as thin stainless steel sheet, thereby the commode-urinal is of light weight and high strength.

Because the urinal is adopted, the commode has the function of processing urine scientifically, therefore, water could be saved significantly during urine-processing; In the meantime, since the urinal is connected through the pivotal means to the main body of the commode so that the operation of changing the state of the commode used for defecating or urinating is quite simple.

Embodiment 2

Figure 5:
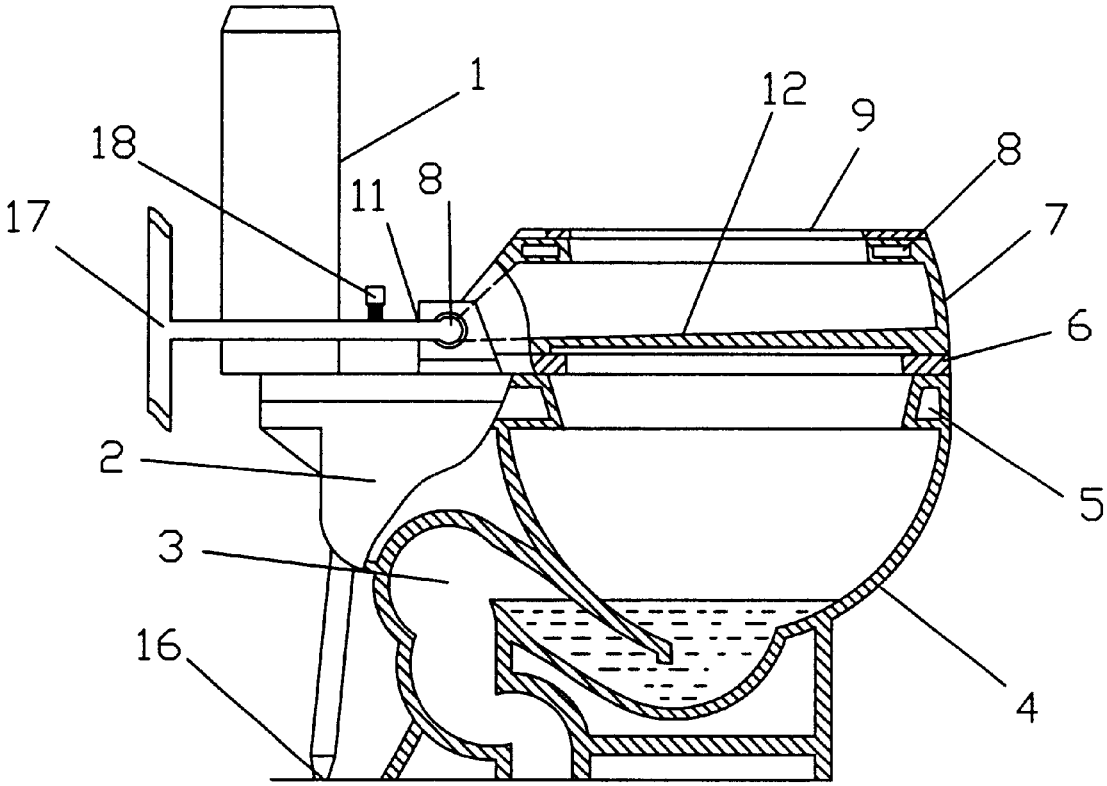
FIG. 5 is a structural sketch of second embodiment of the commode proposed according to the invention.
Figure 6:
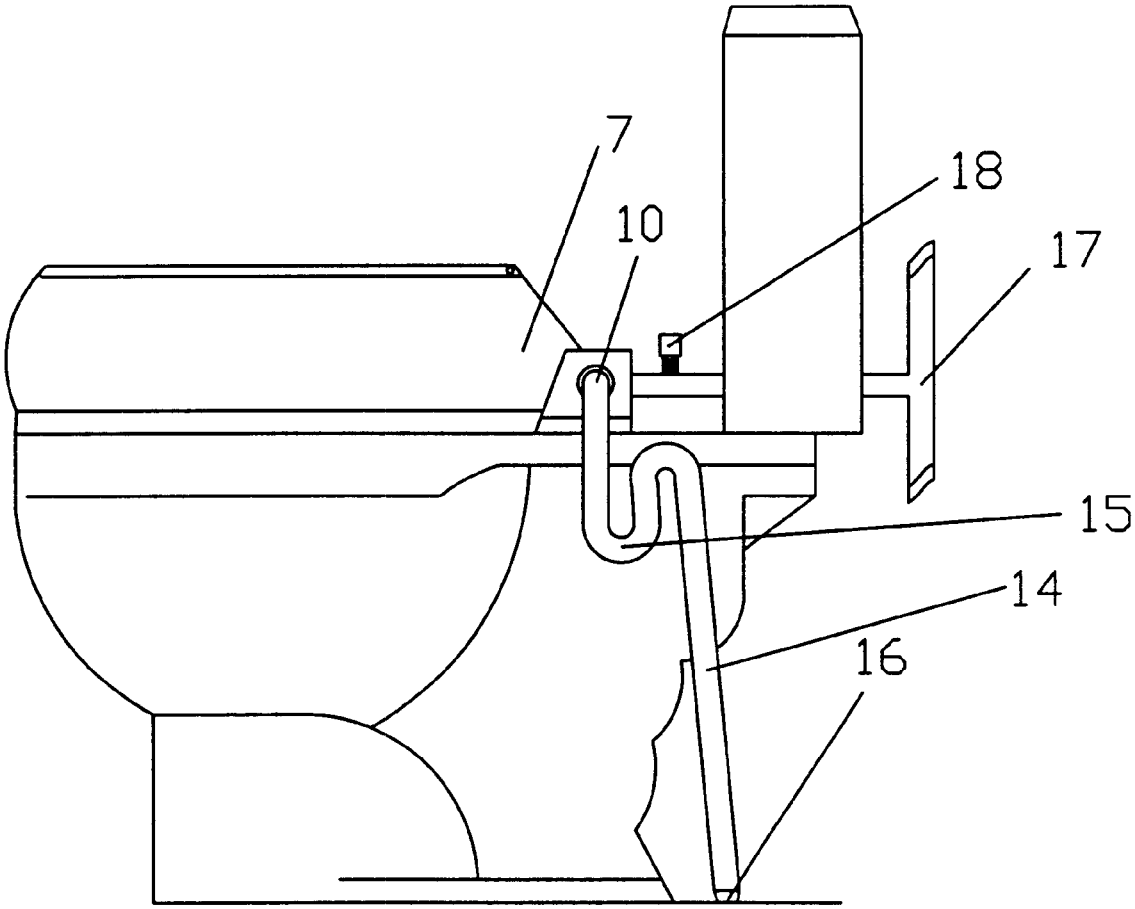
FIG. 6 is a structural sketch of second embodiment of the commode proposed according to the invention in the state used for urinating.

The present embodiment is the same basically as Embodiment 1. As shown in FIG. 5 and FIG. 6, the difference is in that the commode-urinal is adapted for use on top of existing commode-excrement containers. Therefore, the settings of outlet of cleaning-water path 8 of the commode-urinal and outlet 13 of the draining-off path of urinal are different.

The commode-urinal 7 is located above the commode-excrement container and is connected to pivotal means 11 of the urinal, wherein the pivotal means 11 is connected firmly to the main body of the commode by bolts. The cleaning-water path 8 of commode-urinal is connected with tap-water pipe 17. The controlling switch 18 is provided on the cleaning-water path 8 of the urinal, the controlling switch could be a manual control valve and also could be a spring valve. The outlet of the draining-off path of the commode-urinal is connected with sewerage 16 or sewer part of a bath tub directly. The cleaning-water path of the commode-urinal and the outlet of the draining-off path of the commode-urinal are provided independent of the commode-excrement container system thereby it is convenient to modify existing excrement containers to add the commode-urinal.

Figure 9:
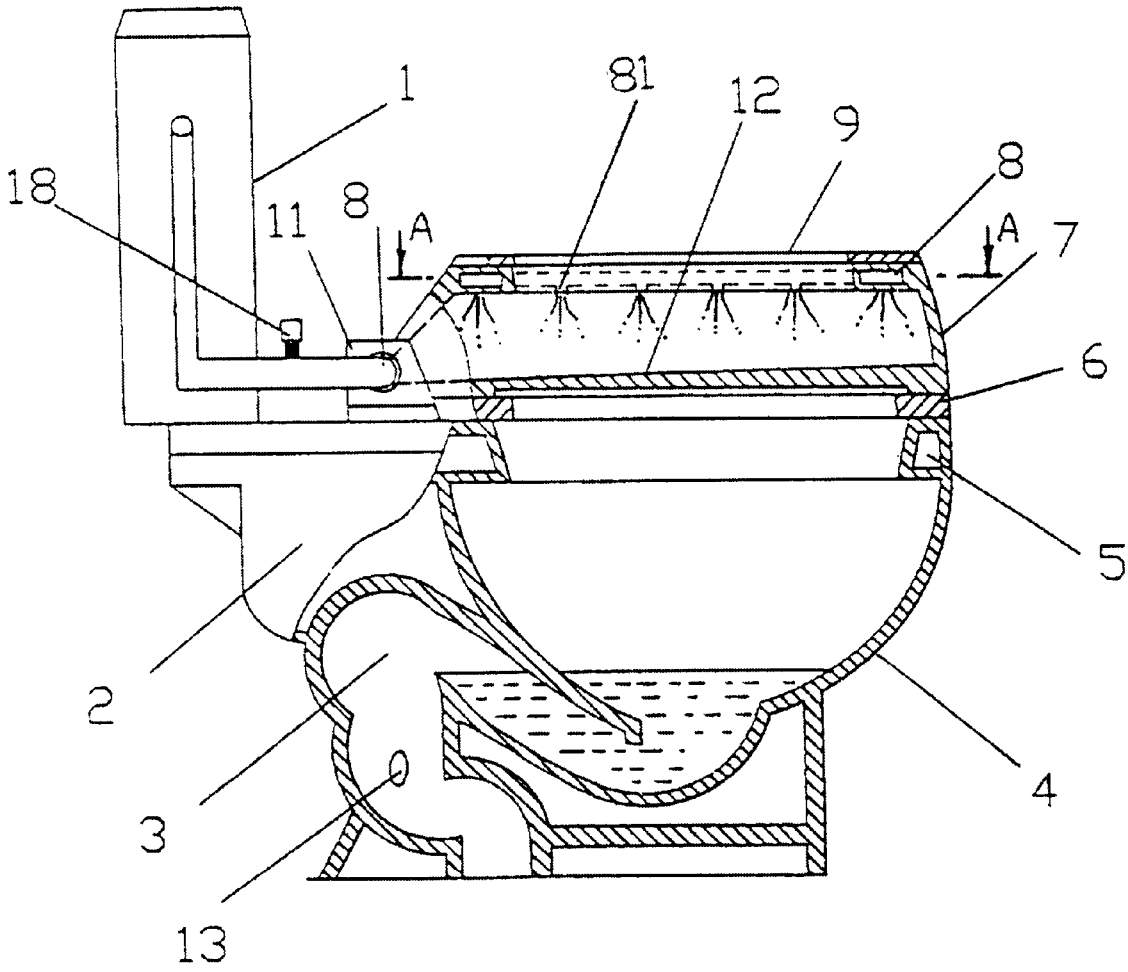
FIG. 9 is a structural sketch of the commode urinal having outlets of the cleaning water path on perimeter edge of the inner chamber upper part of the commode urinal.

The bottom of the inner chamber of the urinal is of inclined-state toward the direction of its draining-off outlet thereby the liquid in the urinal can drain-off the urinal automatically. Moreover, as shown in FIG. 9, the outlets 81 of cleaning-water path 8 of the urinal are arranged on the upper part edge—of the inner chamber of he urinal, wherein the inner chamber is inclined. The inlet 10 of the draining-off path of the urinal is the highest end of the path, therefore, when the urinal is used for urine-processing, urine-liquid can drain-off automatically, hence only a very small amount of cleaning-water is required to clean inner surface of the urinal. In the meantime since the sectional area of the draining-off path of the urinal is much smaller than the sectional area of the draining-off path of the commode-excrement container, its water-containing elbow 15 for water-sealing is also much smaller, the water used for water-sealing is reduced substantially. Thereby the structural combination of the urinal insures a significant water-saving during urine-processing.

The commode-urinal could be made of plastic and other non-metal materials.

Embodiment 3

The present embodiment is the same basically as embodiment 1. The difference is in that the commode-urinal is made of ceramics, a buffer means 19 is provided additionally on the commode-urinal structure of embodiment 1, to prevent the commode-urinal from impacting strongly on the commode-excrement container when the commode-urinal is put down, and causing great noise, even damaging the commode-urinal.

Figure 7:
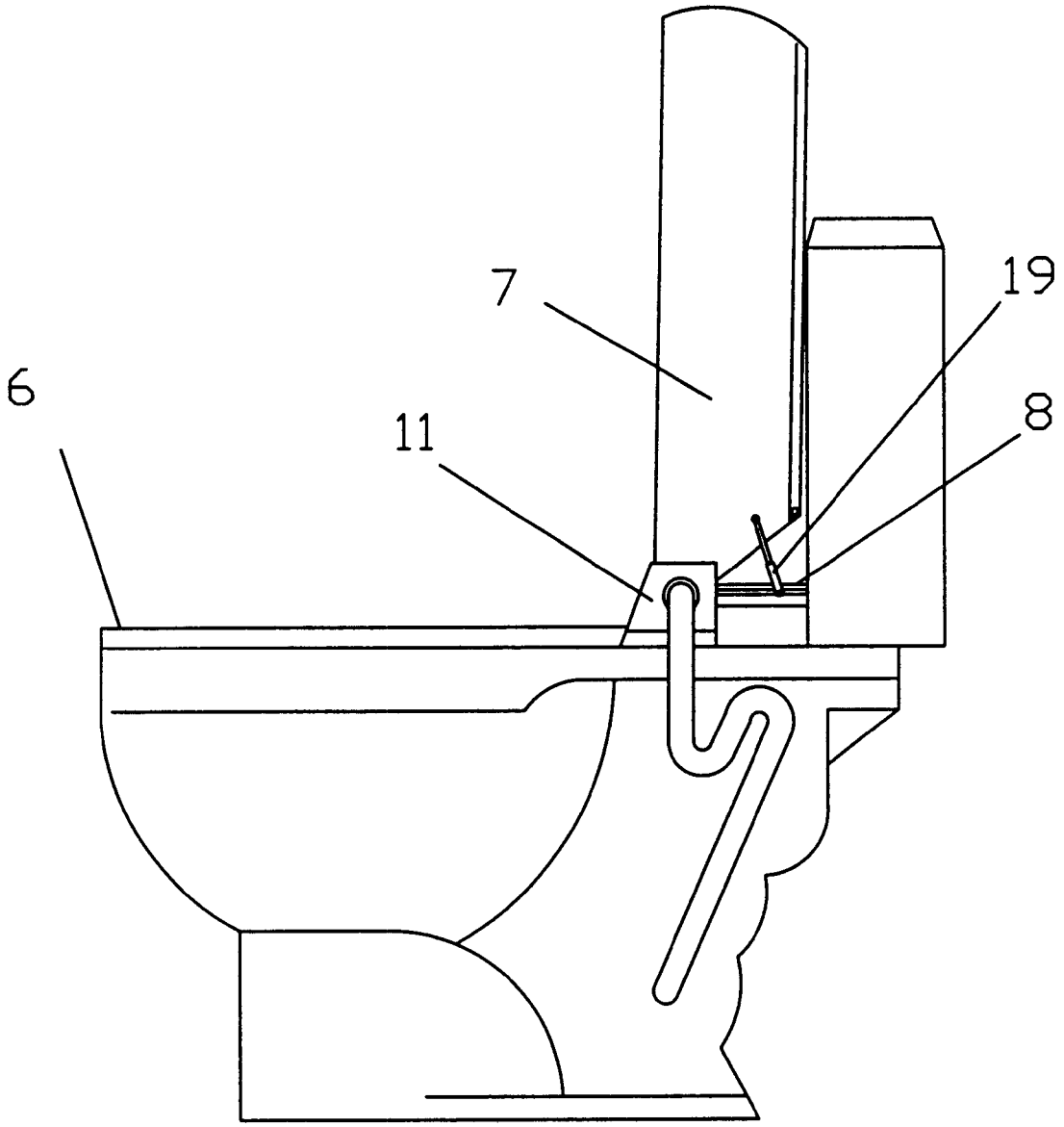
FIG. 7 is a structural sketch of third embodiment of the commode proposed according to the invention.
Figure 8:
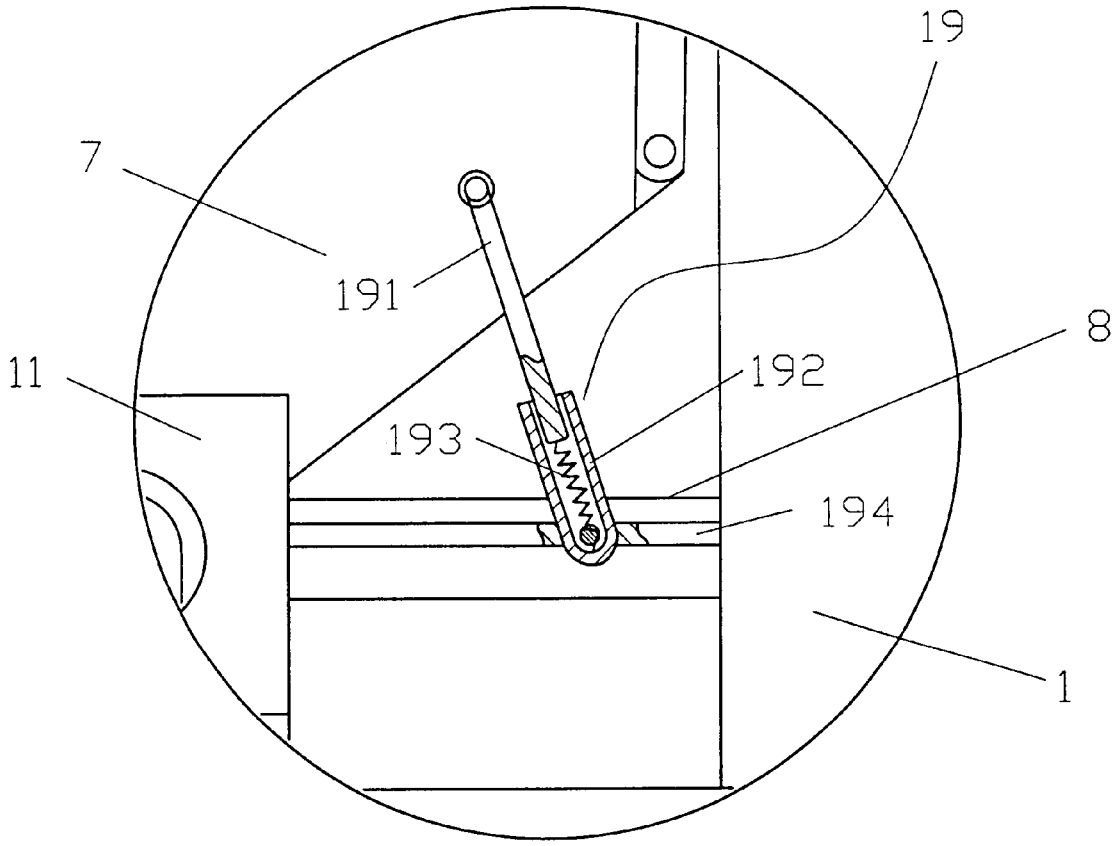
FIG. 8 is a structural sketch of the buffer means of the third embodiment according to the invention.

As shown in FIG. 7 and FIG. 8, a buffer means 19 is provided on the sidewall of the commode-urinal. Buffer means 19 has a fixed rod 194 provided between water-tank 1 and pivotal means 11. The fixed rod 194 is connected through a pivot to a sleeve 192. Inside the sleeve 192, there is a spring 193 connected to a rod 191. This rod 191 extends out of the sleeve 192. The end of the rod 191 is connected through a pivot to the sidewall of the commode-urinal. When the commode-urinal is put down, the buffer means 19 has a certain buffer-effect to the commode-urinal, to prevent the commode-urinal from impacting strongly on the commode-excrement container and causing great noise, even damaging the commode-urinal.

What is claimed is:

1. A commode-urinal pivotally connected to a commode-excrement container, the characteristic is in that: said commode-urinal has a substantially flat exterior bottom seating said commode-urinal on top of a seating potion of said commode-excrement container when in use, and a substantially flat upper seating surface for seating a person for using said commode-urinal; said commode-urinal is provided with a cleaning-water path connected with a water-supplying facility; said commode-urinal is provided with a draining-off path connected directly with a sewer path thereby a liquid in said commode-urinal does not enter said commode-excrement container, wherein said draining-off path of said commode-urinal is provided with a water-containing elbow for water-sealing; said commode-urinal is provided with a pivotal means and is connected through said pivotal means to the upper part of said commode-excrement container.

2. The commode-urinal according to claim 1, the characteristic is in that: said sewer path connected with said draining-off path of said commode-urinal is one selected from the group consisting of sewerage, and a sewer-part of said draining-off path of said commode-excrement container.

3. The commode-urinal according to claim 1, the characteristic is in that: said water-supplying facility connected with said cleaning-water path of said commode-urinal is a water supplying tank of said commode-excrement.

4. The commode-urinal according to claim 1, the characteristic is in that: said water-supplying facility connected with said cleaning-water path of said commode-urinal is a tap water pipe.

5. The commode-urinal according to claim 1, the characteristics in that: a bottom of inner chamber of said commode-urinal is of inclined-state with a lower end toward said draining-off oath to facilitate draining of said liquid in said commode-urinal through said draining-off path.

6. The commode-urinal according to claim 1, the characteristic is in that: a draining off outlets of said commode-urinal is provided on one side of an inner chamber bottom of said commode-urinal.

7. The commode-urinal according to claim 1, the characteristic is in that: outlets of said cleaning-water path of said commode-urinal are provided on perimeter edge of said inner chamber upper part of said commode-urinal.

8. The commode-urinal according to claim 1, the characteristic is in that: said cleaning-water path of said commode-urinal is provided with a controlling switch.

9. The commode-urinal according to claim 8, the characteristic is in that: said controlling switch of said cleaning-water path of said commode-urinal is one selected from the group consisting of a manual control valve, an infrared control valve, and a spring valve.

10. The commode-urinal according to claim 1, the characteristic is in that: said commode-urinal is made of a material selected from the group consisting of plastic, ceramics, and other non-metal materials.

11. The commode-urinal according to claim 1, the characteristic is in that: said commode-urinal is provided with a buffer means on a rear part of a side wall of said commode-urinal to prevent a strong impact of said commode-urinal on said commode-excrement container.

12. A commode-urinal movably seated on a top of a commode-excrement container for use independently from said commode-excrement container, said commode-urinal comprising:

(a) an inner chamber having an inclined bottom to facilitate draining of a liquid in said commode-urinal;

(b) a substantially flat exterior bottom seating said commode-urinal on top of a seating portion said commode-excrement container when in use, and a substantially flat upper seating surface for seating a person for using said commode urinal;

(c) a draining-off path having a water-containing elbow for water-sealing, wherein an inlet of said draining-off path is located at an lower end of said inclined bottom, and an outlet of said draining-off path is connected directly with a sewer-part of said commode-excrement container, thereby said liquid in said commode-urinal does not enter said commode-excrement container;

(d) a cleaning-water path connected with a water-supplying facility; wherein outlets of said cleaning-water path locate on perimeter edge of an upper part of said inner chamber; and (e) a pivotal means pivotally connecting said commode-urinal to an upper part of said commode-excrement container.

13. The commode-urinal according to claim 12 further comprising a controlling switch.

14. The commode-urinal according to claim 13 further comprising a buffer means on a rear part of a side wall of said commode-urinal to prevent a strong impact of said commode-urinal on said commode-excrement container.

15. The commode-urinal according to claim 14, wherein said commode-urinal seats on top of a cover of said commode-excrement container.

16. A commode-urinal in combination with a commode-excrement container comprising:

(i) a commode-excrement container, wherein said commode-excrement container comprises a water supply tank connected to said commode-excrement container, and a first draining-off path at a bottom of said commode-excrement container connected to a sewer-part; and (ii) a commode-urinal pivotally connected to an upper part of said commode-excrement container, wherein said commode-urinal comprises:

(a) an inner chamber having an inclined bottom to facilitate automatic draining of a liquid in said commode-urinal;

(b) a substantially flat exterior bottom seating said commode-urinal on top of a seating portion of said commode-excrement container when in use, and a substantially flat upper seating surface for seating a person for using said commode-urinal;

(c) a draining-off path having a water-containing elbow for water-sealing, wherein an inlet of said draining-off path is located at an lower end of said inclined bottom, and an outlet of said draining-off path is connected directly with a sewer-part of said commode-excrement container, thereby said liquid in said commode-urinal does not enter said commode-excrement container;

(d) a cleaning-water path connected with a water-supplying facility; wherein outlets of said cleaning-water path locate on perimeter edge of an upper part of said inner chamber; and (e) a pivotal means pivotally connecting said commode-urinal to an upper part of said commode-excrement container, wherein said commode-urinal and said commode-excrement container can be used independently from each other.

17. The commode-urinal and commode-excrement container set according to claim 16 further comprising a buffer means on a rear part of a side wall of said commode-urinal to prevent a strong impact of said commode-urinal on said commode-excrement container.

* * * * *